US006405653B1

(12) United States Patent
Miskelly

(10) Patent No.: US 6,405,653 B1
(45) Date of Patent: Jun. 18, 2002

(54) SUPERCAVITATING UNDERWATER PROJECTILE

(75) Inventor: Hermann L Miskelly, Warrenton, VA (US)

(73) Assignee: Atlantic Research Corporation, Gainesville, VA (US)

( * ) Notice: Subject to any disclaimer, the term of this patent is extended or adjusted under 35 U.S.C. 154(b) by 27 days.

(21) Appl. No.: 09/696,688

(22) Filed: Oct. 26, 2000

(51) Int. Cl.[7] ..... F42B 15/20; F42B 21/00

(52) U.S. Cl. ..... 102/374; 102/374; 102/399; 102/490; 89/1.807; 89/1.809

(58) Field of Search ..... 102/490, 399, 102/374, 380; 89/1.807, 1.809, 1.81, 1.813

(56) References Cited

U.S. PATENT DOCUMENTS 1,247,430 A * 11/1917 Loomis ..... 102/499
1,295,047 A * 2/1919 Louden, Sr. ..... 102/399
1,351,540 A * 8/1920 Roos ..... 102/399
2,112,758 A * 3/1938 Blacker ..... 102/374
5,800,224 A 9/1998 Ogino
5,833,501 A 11/1998 Jones
5,929,370 A * 7/1999 Brown et al. ..... 102/399
5,955,698 A 9/1999 Harkins et al.
6,273,015 B1 * 8/2001 Motsenbocker et al. . 114/61.12

* cited by examiner

*Primary Examiner*—Michael J. Carone
*Assistant Examiner*—Lulit Semunegus
(74) *Attorney, Agent, or Firm*—Nixon & Vanderhye P.C.; Frank P. Presta

(57) ABSTRACT

A supercavitating underwater projectile adapted to be fired from a gun or the like, comprising a front end or nose portion and a rear end portion. An auxiliary rocket motor is disposed within the rear end portion of the projectile for providing additional thrust after the projectile has been fired. Vents are disposed within the projectile and are in communication with the rocket motor and the exterior of the projectile for venting some of the combustion gases from the rocket motor to the exterior of the projectile near the nose portion thereof to increase the size of the cavitation bubble formed as the projectile travels through the water and thereby reduce hydrodynamic drag on the projectile.

12 Claims, 1 Drawing Sheet

SUPERCAVITATING UNDERWATER PROJECTILE

BACKGROUND OF THE INVENTION

The present invention relates to an underwater projectile and, more particularly, to a supercavitating underwater projectile that is constructed to enlarge the naturally occurring cavitation bubble to reduce hydrodynamic drag.

In anti-torpedo or anti-mine systems or the like, an underwater projectile is fired from a gun to intercept and/or destroy the torpedo or mine. While such underwater projectiles have been shaped to form a cavitation void around the projectile in the water to reduce hydrodynamic drag, the velocity, size and range of the projectiles have been limited by such drag. Accordingly, a need has arisen for a new and improved underwater projectile for anti-torpedo or anti-mine use or the like which has increased range and/or lethality. The supercavitating underwater projectile of the present invention meets this need.

SUMMARY OF THE INVENTION

The supercavitating underwater projectile of the present invention is constructed to increase the velocity of the projectile when fired, and thus its lethality upon impacting the target, through supplemental propulsion and the expansion of the cavitation bubble around the projectile, allowing for a larger projectile with reduced hydrodynamic drag.

This is accomplished by providing a small rocket motor in the projectile which is ignited by the hot gases of the gun powder charge of the gun system when fired to eject the projectile from the gun barrel. The ignition of the rocket motor provides additional axial thrust to increase the velocity of the projectile in the water and thus its lethality and/or range. The projectile comprises an internal ventilation system for venting some of the propellant combustion gases to the exterior of the projectile near the front or nose portion thereof. The vented combustion gases serve to expand the naturally occurring cavitation bubble formed as the projectile travels through the water to reduce hydrodynamic drag. In this manner, the velocity, range and lethality of the projectile are increased. Also, larger projectiles can be employed.

DESCRIPTION OF THE PREFERRED EMBODIMENTS

Figures 1, 2:
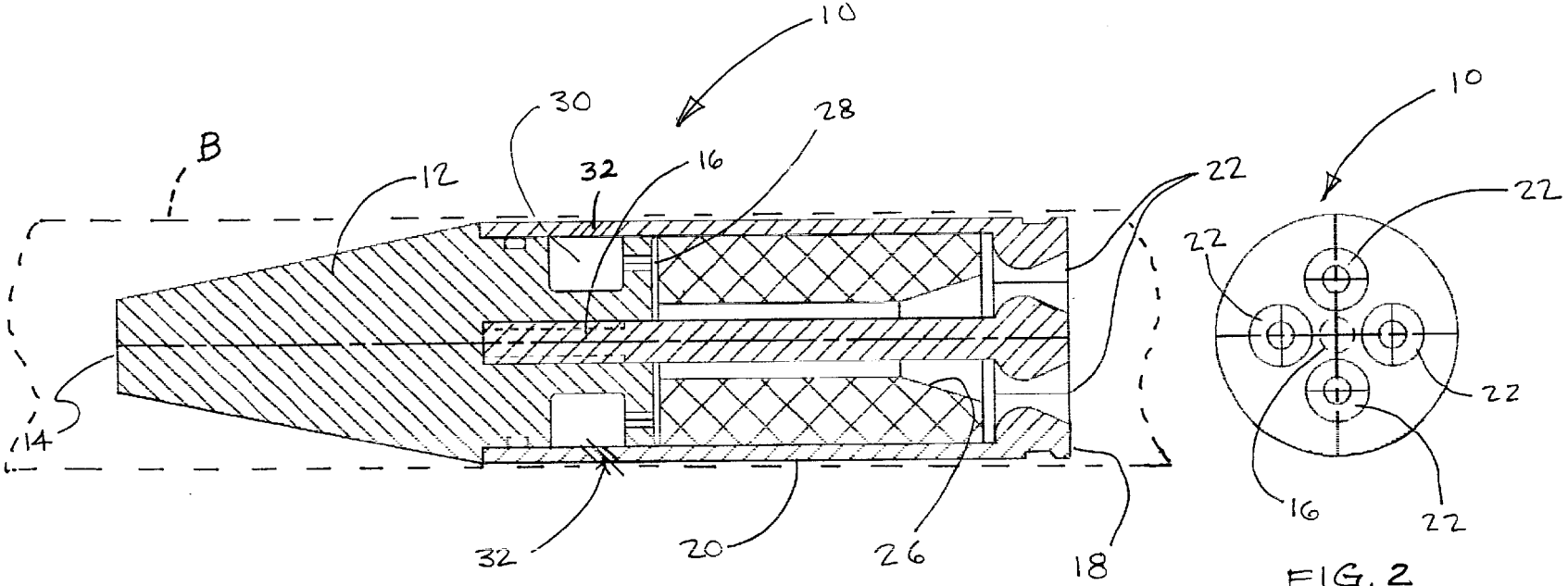
FIG. 1 is a side elevational view in section of an underwater projectile constructed in accordance with the principles of the present invention.
FIG. 2 is a rear elevational view of the underwater projectile shown in FIG. 1.

As shown in FIGS. 1 and 2, the supercavitating underwater projectile 10 of the present invention generally comprises a front end or nose portion 12 that is tapered forwardly and inwardly and terminates in a blunt nose 14. A longitudinally extending center post 16 is secured at its front end to the nose portion 12 and extends to the rear end portion 18 of the projectile 10.

A generally cylindrical case or housing 20 is mounted in any suitable manner on the rear end of the nose portion 12 and is shaped at the rear end portion thereof to define a plurality of nozzles 22 with the enlarged rear end of the center post 16. The nozzles 22 may be of any suitable construction, size and number. As shown in FIG. 2, the nozzles 22 preferably are slightly canted to impart radial movement to the projectile and minimize flight path deviations.

Between the rear end of the nose portion 12 and the nozzles 22, a suitable propellant 24 is mounted within the housing 20 in surrounding relation to the center post 16, as shown in FIG. 1. The propellant 24 preferably is a solid propellant of any suitable composition. The inner annular surface 26 of the rear end portion of the propellant 24 may be tapered outwardly and rearwardly to expose a greater surface of the propellant to the nozzle openings to facilitate ballistic performance control and ignition of the propellant as described hereinafter.

The rear end of the nose portion 12 disposed adjacent the propellant 24 is provided with bleed vents 28 of any suitable construction which are in communication with the propellant and also with an ullage chamber 30 in the nose portion. The housing 20 is provided with a plurality of cavitation vents 32 that lead from the ullage chamber 30 to the exterior of the projectile. Preferably, the cavitation vents 32 are angled rearwardly as shown in FIG. 1 to minimize impingement and jet effects.

The nose portion 12, center post 16 and housing 20 may be of any suitable construction and may be formed of any suitable material, such as steel or another metallic or non-metallic material. These components may be assembled in any suitable manner.

In the operation of the present invention, the underwater projectile 10 is slidably mounted within a barrel B, shown in broken lines in FIG. 1 of a suitable gun system or the like (not shown). Upon the firing of the gun, the hot gases in the barrel B from the gun powder charge enter the nozzles 22 and ignite the propellant 24 as the projectile is being ejected from the barrel. The ignition of the propellant serves to generate propellant gases that exit the nozzles 22 to increase the velocity of the projectile and thus its lethality upon impacting the intended target.

The blunt and tapered nose portion 12 forms a cavitation bubble around the projectile 10 as it travels through the water. Some of the propellant gases travel through the bleed vents 28 into the ullage chamber 30 and then out the cavitation vents 32 to enlarge the cavitation bubble and thus reduce the hydrodynamic drag on the projectile as it is moving through the water. In this manner, the velocity, range and lethality of the projectile are increased. More specifically, relying on kinetic energy for destroying the intended target, such as a torpedo or mine, the increasing of the velocity of the projectile ($KE=\frac{1}{2} mv^2$) through the use of the rocket motor significantly increases either the lethality of the projectile (increased velocity at a given distance) or the range of the projectile (increased distance at a given velocity). By enlarging the cavitation bubble surrounding the projectile and thus reducing hydrodynamic drag, larger projectiles can be employed for this purpose.

From the foregoing description, it will be readily seen that the new and improved supercavitating underwater projectile of the present invention is simple in construction, reliable in operation and is capable of increased range and lethality with reduced hydrodynamic drag compared to existing underwater projectiles used for similar purposes.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A supercavitating underwater projectile adapted to be fired from a gun, comprising a front end portion and a rear end portion;

an auxiliary rocket motor disposed within the rear end portion of the projectile for providing additional thrust after the projectile has been fired; and vents disposed within the projectile and in communication with said rocket motor and the exterior of the projectile for venting some of the combustion gases from said rocket motor to the exterior of the projectile near said front end portion thereof to increase a size of the cavitation bubble formed as the projectile travels through the water and thereby reduce hydrodynamic drag on the projectile.

2. The underwater projectile of claim 1 wherein said rocket motor comprises a solid propellant that is ignited by the hot gases generated when the projectile is fired.

3. The underwater projectile of claim 1 wherein said rocket motor comprises a plurality of nozzles at the rear end thereof for ejecting propellant gases in a predetermined manner to stabilize the path of the projectile.

4. The underwater projectile of claim 1 wherein said vents are in communication with an ullage chamber disposed within the projectile near said front end portion thereof.

5. The underwater projectile of claim 4 wherein said vents are angled rearwardly from said ullage chamber to the exterior of the projectile.

6. The underwater projectile of claim 1 wherein said front end portion is provided with a blunt nose section for facilitating the formation of the cavitation bubble.

7. A supercavitating underwater projectile adapted to be fired from a gun, comprising:

a nose portion;

an elongated housing mounted on said nose portion and extending rearwardly therefrom, said housing having a plurality of nozzles at the rear end portion thereof;

an auxiliary propellant disposed within said housing between said nose portion and said nozzles for providing additional thrust after the projectile has been fired; and vents disposed within said nose portion and said housing in communication with said propellant and the exterior of the projectile for venting some of the combustion gases from said propellant to the exterior of the projectile to increase a size of the cavitation bubble formed as the projectile travels through the water to reduce hydrodynamic drag on the projectile.

8. The underwater projectile of claim 7 wherein said nose portion is tapered inwardly and forwardly, and has a blunt front end.

9. The underwater projectile of claim 7 further comprising an elongated center post that extends longitudinally from said nose portion through said propellant to said rear end portion of said housing, said center post defining said nozzles with said rear end portion of said housing.

10. The underwater projectile of claim 7 wherein said vents comprise bleed vents in the rear end of said nose portion in communication with said propellant, an ullage chamber in said nose portion in communication with said bleed vents, and cavitation vents in said housing in communication with said ullage chamber and the exterior of the projectile.

11. The underwater projectile of claim 10 wherein said cavitation vents are angled rearwardly.

12. The underwater projectile of claim 7 wherein said propellant is a solid propellant.

* * * * *